United States Patent [19]

Mamula et al.

[11] 4,276,956

[45] Jul. 7, 1981

[54] SWING SCAFFOLD FOR HOT BLAST STOVE CHECKER CHAMBER RELINING

[75] Inventors: Ronald S. Mamula, Williamsville, N.Y.; Samuel C. Dotson, Weirton, W. Va.

[73] Assignee: Andco Incorporated, Buffalo, N.Y.

[21] Appl. No.: 112,611

[22] Filed: Jan. 16, 1980

Related U.S. Application Data

[62] Division of Ser. No. 935,706, Aug. 21, 1978, Pat. No. 4,221,537.

[51] Int. Cl.[3] ..... E04G 3/10; E04G 5/08

[52] U.S. Cl. ..... 182/128; 182/129; 182/142; 182/222

[58] Field of Search ..... 182/128, 142, 143, 144, 182/150, 222, 223, 129, 130; 52/749; 414/786

[56] References Cited

U.S. PATENT DOCUMENTS

| | | | |
|---|---|---|---|
| 306,526 | 10/1884 | Rossvally | 182/142 |
| 2,420,373 | 5/1947 | Hogberg | 263/19 |
| 2,428,461 | 10/1947 | Kinney et al. | 263/51 |
| 3,193,974 | 7/1965 | Nelson | 50/536 |
| 3,210,060 | 10/1965 | Ramacciotti | 263/19 |
| 3,560,164 | 7/1969 | Venable | 52/749 |
| 3,888,062 | 6/1975 | Gregord | 52/749 |
| 3,927,502 | 12/1975 | Smith | 52/749 |
| 3,955,685 | 5/1976 | Smith | 182/142 |
| 4,033,463 | 7/1977 | Cervin | 52/749 |
| 4,221,537 | 9/1980 | Mamula | 414/786 |

*Primary Examiner*—Reinaldo P. Machado
*Attorney, Agent, or Firm*—Christel, Bean & Linihan

[57] ABSTRACT

A process of erecting interior combustion and checker chambers in a hot blast stove by lining the checker chamber and building the chamber wall from a vertically movable scaffold in the checker chamber shaped to conform with the interior thereof, laying up checkerwork in the checker chamber beneath the movable scaffold, these two operations being supplied from outside the stove through feed openings at progressive heights, and lining the combustion chamber from a vertically movable work scaffold within the combustion chamber. All three principle operations are carried on concurrently.

3 Claims, 10 Drawing Figures

Fig. 5.
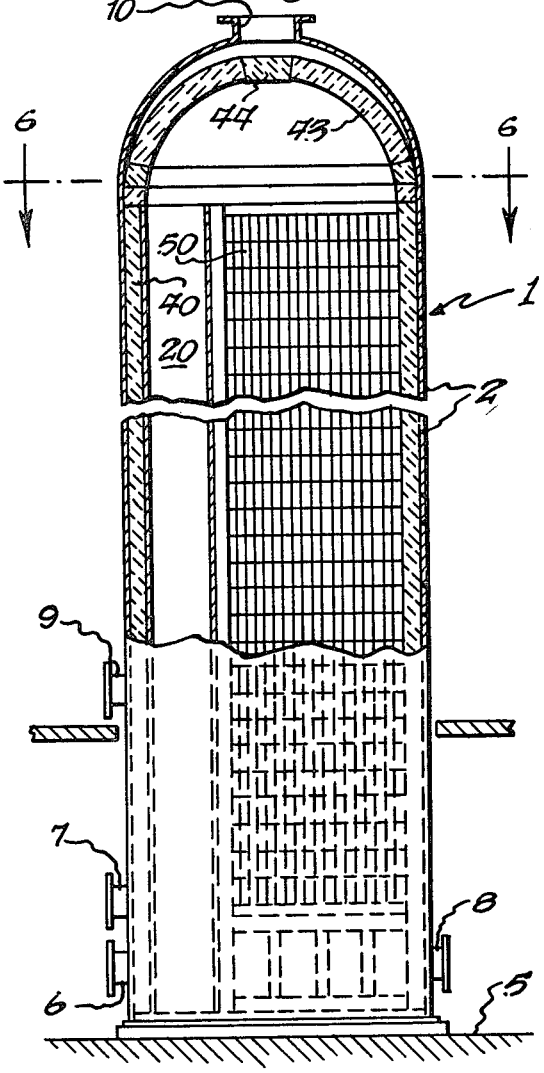
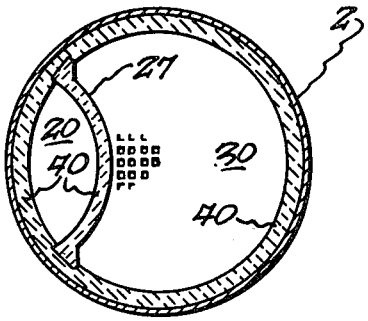
Fig. 6.
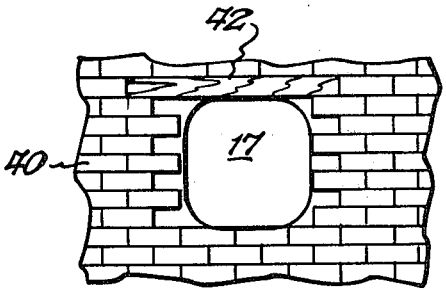
Fig. 7.
Fig. 8.
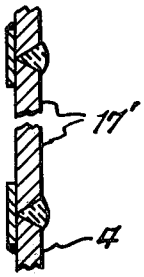
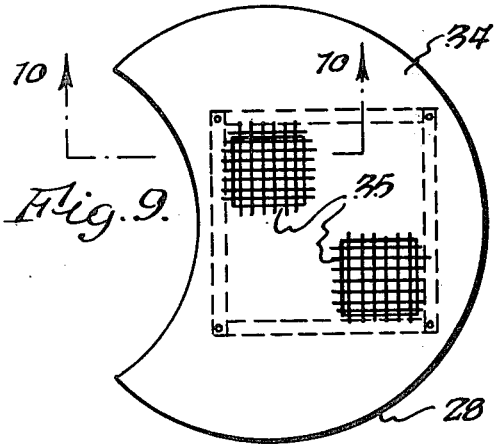
Fig. 9.
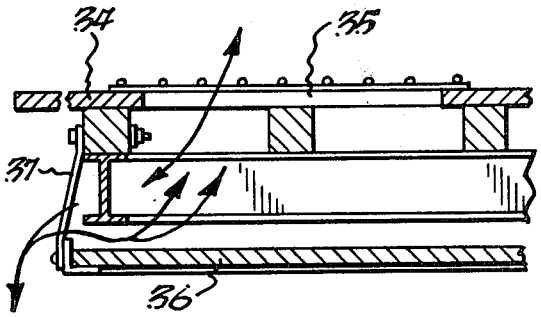
Fig. 10.

SWING SCAFFOLD FOR HOT BLAST STOVE CHECKER CHAMBER RELINING

This is a division of application Ser. No. 935,706 filed Aug. 21, 1978 now U.S. Pat. No. 4,221,537.

BACKGROUND AND SUMMARY OF THE INVENTION

This invention relates to hot blast stoves which provide the continuous blast of hot air to a blast furnace in the iron making process. More specifically, the invention is an improved process by which to erect the refractory interior of such a stove.

Typically, there are three stoves to supply the hot blast to a blast furnace. The stoves are tall steel cylinders, lined with brick and nearly filled with a type of brick called checkerwork. The checker bricks store heat produced by burning by-product gas from the furnace. The hot gas passes through the many small passageways in the checker bricks until they are thoroughly heated. Then combustion is stopped and a blast of ambient clean air is blown through the stove, picking up the heat from the checkerwork to make the hot blast for the furnace. The stoves are alternately cycled in this manner, one "on blast" while another is "on gas" so there is always a continuous hot blast for the furnace. A hot blast stove includes as principal parts a shell, combustion chamber, checkerwork, and control valves and lines to regulate and carry the various gases.

The shell is a welded steel jacket, 20–30 feet in diameter, domed at the top, and usually 100–150 feet high. The shell houses the combustion chamber and the checker chamber. A shell must be designed not only to support the brick structure inside, but to withstand the 30–50 psig blast pressure. The shell is insulated from the brickwork to avoid structural damage from the heat and to prevent loss of heat to the atmosphere.

The combustion chamber is constructed of brick with an inner "skinwall" that is free to expand and contract in response to temperature changes. The combustion chamber must be designed to occupy as little of the stove interior as possible and still provide proper flow mixing and combustion of gases.

The checker chamber is completely filled with checker bricks, which have many small, in-line holes (flues) where heat is transferred to and from the gas. Modern checkerwork consists of bricks with many small flues, whereas older checkerwork had to have larger openings to minimize clogging from the action of dirty furnace gas. Improved gas cleaning and more stable brick materials have made possible the small openings which expose a maximum surface area to the gas. Within the checkerwork, different qualities of brick material are used in the several vertical zones where heat, chemical action and structural requirements vary.

Normal stove operation consists of two cycles:

"On Gas"—when the checkerwork is receiving heat from burning furnace gas, and "On Blast"—when the checkerwork is giving up heat to make the hot blast. A stove that is heated but not being utilized for the hot blast is said to be "bottled".

A blast furnace plant runs continuously for an extended period, typically five to seven years, after which it is shut down for maintenance and rebuilding as necessary. During such shutdowns, the stoves are gutted of refractory lining and checkerwork and are relined with brickwork and restacked with checkerwork. This has been done in the past by sequentially performing the relining of the combustion chamber, then of the checker chamber, then laying up of checkerwork. The prior art method might be characterized as a single crew performing the several operations in series.

By the process of this invention, the three major rebuild procedures are performed simultaneously by a safer operation for an improved result with less material breakage, and all at a great reduction in expensive downtime. The new method might be characterized as several crews performing the several operations in parallel.

Briefly, the process of this invention can be summarized as:

A process of erecting interior combustion and checker chambers in a hot blast stove by lining the checker chamber and building the chamber wall from a vertically movable scaffold in the checker chamber shaped to conform with the interior thereof, laying up checkerwork in the checker chamber beneath the movable scaffold, these two operations being supplied from outside the stove through feed openings at progressive heights, and lining the combustion chamber from a vertically movable work scaffold within the combustion chamber. All three principal operations are carried on concurrently.

The details and benefits of the present invention will now be more specifically described with reference to the accompanying drawing.

DRAWING

FIG. 5 is a view similar to FIG. 4, the rebuild process now complete.

FIG. 6 is a sectional plan view taken along line 6—6 of FIG. 5.

FIG. 7 is a fragmentary elevational view of brickwork and shell as indicated by line 7—7 of FIG. 4.

FIG. 8 is a fragmentary section of a portion of the stove shell.

FIG. 9 is a plan view of the work platform in the checker chamber.

FIG. 10 is a partial section of the work platform taken along line 10—10 of FIG. 9.

DESCRIPTION

Figure 1:
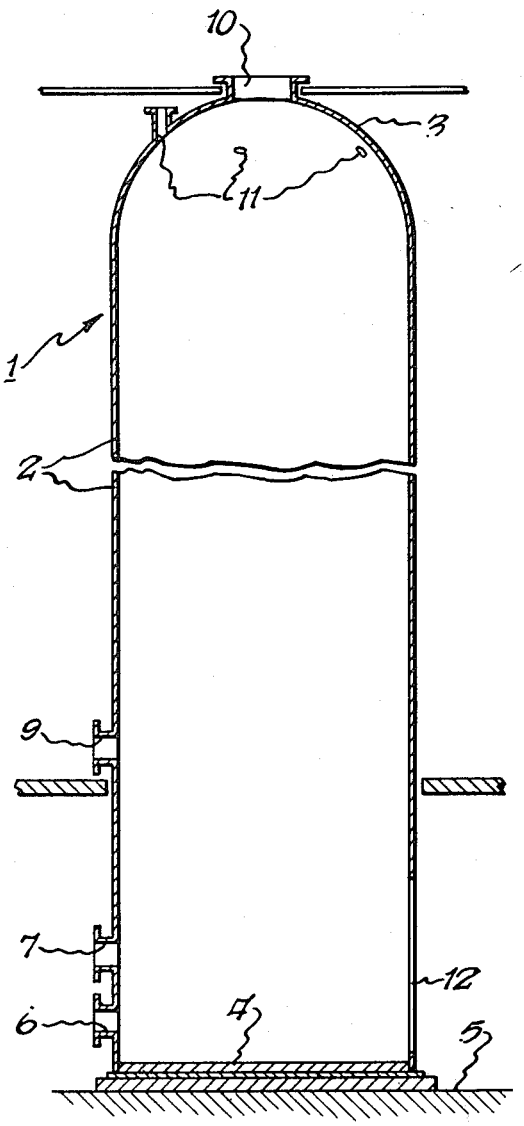
FIG. 1 is a sectional elevation of a hot blast stove shell, empty of refractory and ready for rebuilding.

In FIG. 1, a hot blast stove is represented at 1 and includes, at this stage, an empty steel shell 2 topped by a dome 3 and including a bottom end 4 all mounted on a foundation or bottom pad 5. A combustion gas inlet 6 and a combustion air inlet 7 enter the stove near its bottom end on the combustion chamber side. A cold blast air inlet 8 (FIG. 2) and a hot blast air outlet 9 lead respectively to and from the stove. Dome 3 includes a manhole 10 and a plurality of smaller hoist line apertures 11. Stove 2 as shown in FIG. 1 has been emptied and cleaned of internal brickwork and checkerwork. An 8' by 14' section of shell wall has been cut away leaving a bottom access opening 12 for the tearout. The stove is ready for relining and restacking. The following description of this rebuild process is intended as a chronological account of the sequence of operations.

Figure 2:
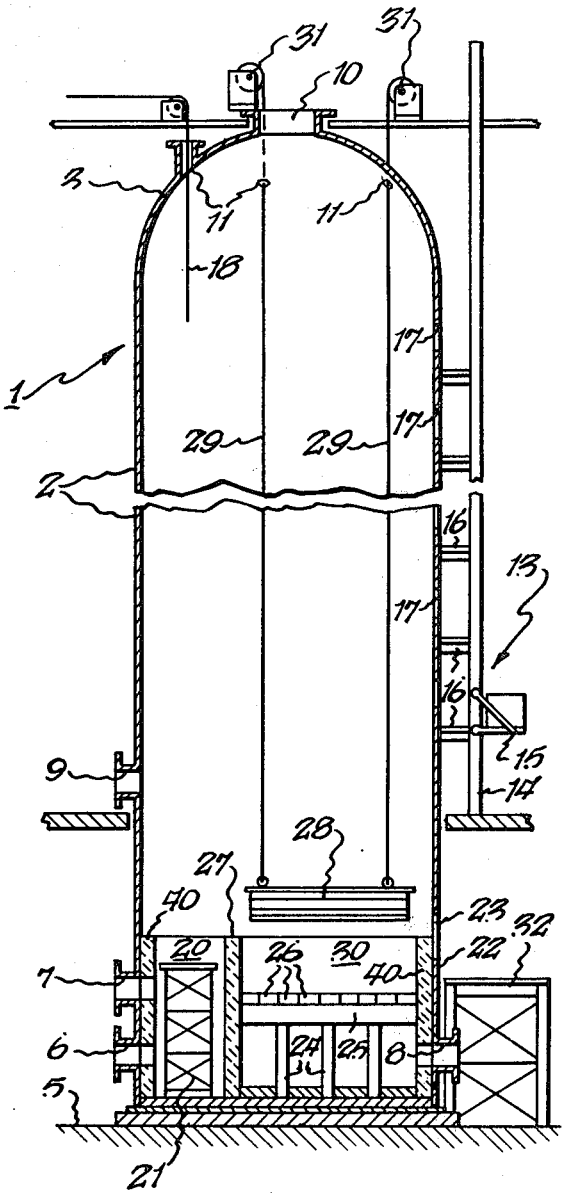
FIG. 2 is a view similar to FIG. 1, shown at a setting-up stage in the rebuild process.

Reference is now made to FIG. 2. An outside material elevator 13 is erected on the outside of the stove, opposite the combustion chamber 20. Elevator 13 includes a vertical track 14 and an elevator car 15 movably mounted on the track. A track mounting fixture and work platform 16 is located every 8' along the length of the track 14 connecting the track to the stove. Midway between platforms 16, brick feed openings 17 of approximately 2½' by 2½' are cut in the stove shell. A hoist line 18 is connected to a hoist mechanism, not shown, and depends through a line aperture 11 to a brick sling 19 (FIG. 3) is combustion chamber 20.

Figure 3:
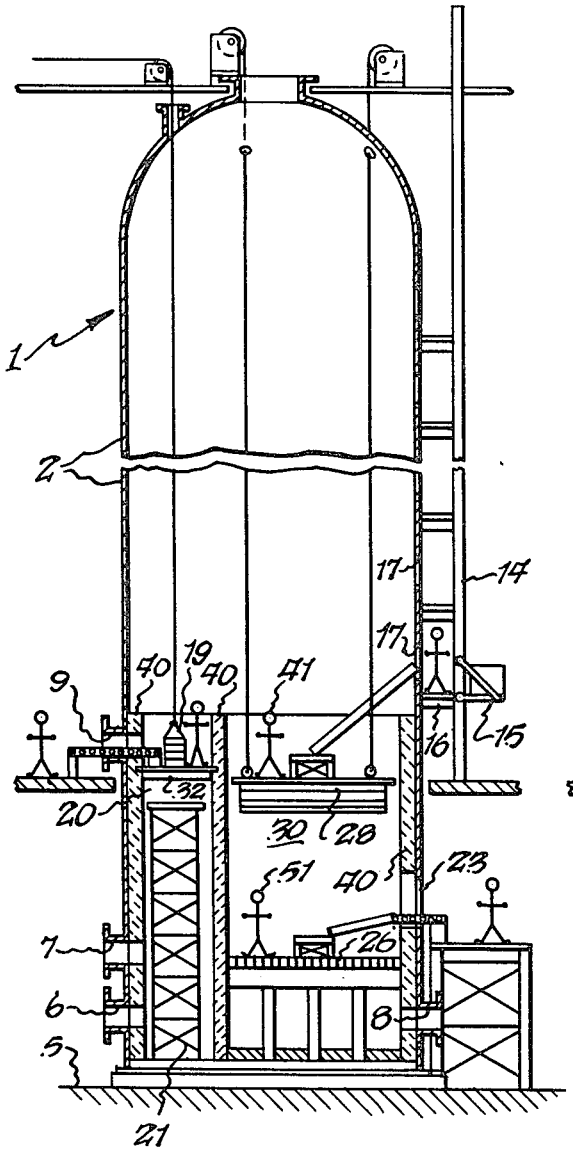
FIG. 3 is a view similar to FIG. 2, shown at an early stage in the rebuild process.

Stationary scaffolding 21 is erected in combustion chamber 20 in four-foot height increments. FIG. 2 shows an accumulation of 3 four-foot sections of scaffold. FIG. 3 by comparison shows the scaffold six sections high extending within reach of the air outlet 9.

The 8' by 14' section of shell plate that was removed for the tearout opening 12 is cut horizontally leaving an 8' by 10' section 22 which is reinstalled, leaving a 4' by 8' opening 23. Section 22 includes cold blast air inlet 8. Stationary scaffolding 32 is erected outside the stove next to section 22 providing worker access to opening 23.

A plurality of vertical steel columns 24 are installed. Columns 24 support steel cross girders 25 which in turn support a grid array 26, all this forming a foundation for the stacking of checkerwork. Brickwork 40 is layed up lining the shell to and forming the combustion chamber 20 by chamber wall 27.

When brickwork 40 is laid up to the height of grids 26, a swing scaffold 28 is suspended in the checker chamber 30 from four hoist lines 29 depending through apertures 11 and connected to external winches 31.

Reference is now made to FIG. 3. Wall brickwork 40 is here laid up to the top of the hot blast air outlet 9. A stationary platform, or so-called Pudlock scaffold 32 is now installed in the combustion chamber 20 just below the blast air outlet 9, and scaffolding 21 in the combustion chamber below it is removed. From this point, considered as FIG. 3 with scaffolding 21 removed from the combustion chamber, brickwork in the stove can proceed simultaneously in three areas: one crew on wall brick 40, one crew laying checkers 50, and one crew laying the ceramic burner and related refractory work in the combustion chamber.

Figure 4:
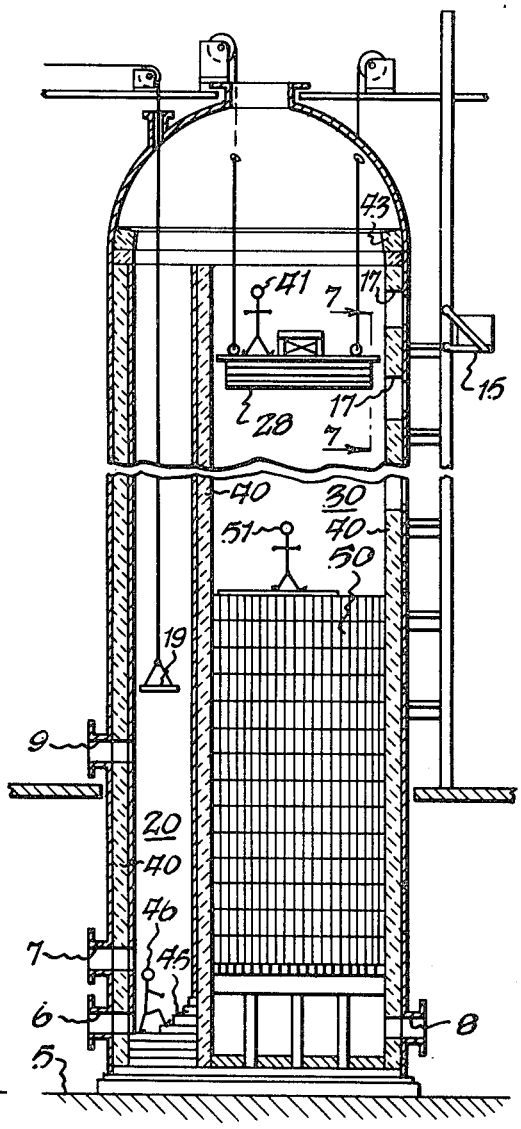
FIG. 4 is a view similar to FIG. 3, shown at an intermediate stage in the rebuild process.

Reference is now made to FIG. 4. The wall brick crew 41 is working within the checker chamber 30 from scaffold 28 laying wall brickwork 40. Simultaneously, wall brickwork 40 is being laid up around the combustion chamber 20 from brick sling 19. The crew on scaffold 28 is supplied with materials from outside elevator 15 through feed openings 17. Sling 19 in the combustion chamber is supplied with materials through blast air outlet 9. As the work progresses, outlet 9 remains open and the sling 19 simply moves up and down as required for more supplies. In the checker chamber 30 however, the progressing brickwork is supplied through progressively higher openings 17. The brick crew on swing scaffold 28 leaves each opening 17 clear as it progresses beyond it upward to use the next opening for supplies. The openings 17 left behind by the wall brick crew appear from inside the stove as shown in FIG. 7.

Meanwhile, beneath the scaffold 28 the checkerwork crew 51 is laying up checkers 50. As crew 51 progresses, it too is supplied from elevator 15 and openings 17. However, as crew 51 raises to a next higher opening for supplies, the superseded opening 17 is closed. First the shell plate 17' is replaced. Then, the temporary wood support piece 42 is removed and the brickwork 40 completed, blocking up the opening 17. The steel shell 17' at opening 17 is replaced as shown in FIG. 8 by standard welding and fabrication methods.

Again meanwhile, a burner crew 46 is supplied through inlets 6 and 7 and is laying refractory or ceramic burner 45 in the lower combustion chamber.

The wall brick crew 41 completes the wall bruckwork 40 and installs part of the dome brick work 43. Then the scaffold 28 is dismantled and removed. The burner crew 46 completes the ceramic burner to near the height of the outlet 9. Then the sling 19 and Pudlock scaffold 32 are removed and the hoist line apertures 11 closed. The checker crew 51 finishes laying up checkers and finishes installing the dome brickwork 43. The crew then exits through manhole 10 before finally inserting the dome capstone 44. FIG. 5 shows the finished product with all scaffolding and support equipment removed.

FIG. 9 is a plan view of the platform of swing scaffold 28. It is shaped to conform with the shape of checker chamber 30, as seen in FIG. 6, in which scaffold 28 moves up and down. Scaffold 28 inclues a top platform 34 having an open grill 35 in part of its area to permit easy air flow in the checker chamber from one side to the other side of the swing scaffold. A catch board 36 is suspended from platform 34 to catch debris, such as bits of broken bricks, to prevent its falling into the checker chamber. This is for the safety of the checker crew and also for the benefit of the checkerwork. Catch board 36 is smaller in extent than platform 34 to permit air passage as indicated by the arrow. Board 36 is held to the platform 34 by brackets 37 which are themselves latticed or grilled for passage of air and at the same time for retention of debris.

It is considered that the process described provides several significant advantages. Expensive downtime of the stoves, which typically extends to several weeks, may be cut by a third. The process is more efficient with the brickwork, checkerwork, and combustion chamber refractory work being done concurrently. The three crews working separately and in parallel, as it were, rather than all together throughout a series of operations, means fewer people at any time at any work area. Thus the procedure is inherently safer.

It should be borne in mind that FIGS. 1–5 are cutaway elevations, showing only the lower and the upper portions of the stove with a substantial portion, more than half, of the height of the stove removed. The significance of accomplishing the several operations concurrently and in parallel is more readily appreciated by considering that these parallel operations are performed, concurrently through most of the height of the stove and that the stove height is more than twice what is illustrated.

The foregoing specification describes the concept of this invention and the best mode presently contemplated for practicing the same. The scope of the invention is limited only by the purview of the following claims.

What is claimed is:

1. A swing scaffold for use in relining the checker chamber of a hot blast stove comprising a platform shaped to conform with the shape of the checker chamber, an open grill in said platform to permit air flow through said scaffold from one side to the other, and a catch board suspended from said platform to catch debris passing through said grill and prevent it from falling into the chamber below.

2. A swing scaffold as set forth in claim 1, said platform being generally circular in outline and having a concave peripheral portion shaped to conform to an internal chamber wall separating a combustion chamber from a checker chamber in a hot blast stove.

3. A swing scaffold as set forth in claim 1, said catchboard being suspended from said platform by means permitting the passage of air while retaining debris on the catchboard.

* * * * *